US011891888B2

(12) United States Patent
Chen et al.

(10) Patent No.: US 11,891,888 B2
(45) Date of Patent: Feb. 6, 2024

(54) MEASURING FORMATION PROPERTIES AND DRILLING MUD PROPERTIES USING NUCLEAR MAGNETIC RESONANCE IN A WELLBORE

(71) Applicant: Halliburton Energy Services, Inc., Houston, TX (US)

(72) Inventors: Songhua Chen, Katy, TX (US); Rebecca Jachmann, Spring, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 17/475,574

(22) Filed: Sep. 15, 2021

(65) Prior Publication Data

US 2023/0084875 A1 Mar. 16, 2023

(51) Int. Cl.

| | |
|---|---|
| ***E21B 44/00*** | (2006.01) |
| ***E21B 47/085*** | (2012.01) |
| ***E21B 49/08*** | (2006.01) |
| ***E21B 49/00*** | (2006.01) |

(52) U.S. Cl.

CPC ..... *E21B 44/00* (2013.01); *E21B 47/085* (2020.05); *E21B 49/005* (2013.01); *E21B 49/0875* (2020.05)

(58) Field of Classification Search

CPC ..... E21B 44/00; E21B 47/085; E21B 49/005; E21B 49/0875

See application file for complete search history.

(56) References Cited

U.S. PATENT DOCUMENTS

| | | | | |
|---|---|---|---|---|
| 10,983,077 | B2 | 4/2021 | Chen et al. | |
| 2008/0215245 | A1* | 9/2008 | Reittinger | E21B 49/10 73/152.55 |
| 2009/0051359 | A1 | 2/2009 | Blanz et al. | |
| 2011/0068787 | A1 | 3/2011 | Freedman et al. | |

(Continued)

FOREIGN PATENT DOCUMENTS

| | | | |
|---|---|---|---|
| WO | 2011095600 | A2 | 8/2011 |
| WO | 2017030523 | A1 | 2/2017 |
| WO | 2020086874 | A1 | 4/2020 |

OTHER PUBLICATIONS

PCT Application No. PCT/US2021/050389, "International Search Report and Written Opinion", dated Jun. 9, 2022, 10 pages.

(Continued)

*Primary Examiner* — Tara Schimpf
*Assistant Examiner* — Yanick A Akaragwe
(74) *Attorney, Agent, or Firm* — Kilpatrick Townsend & Stockton LLP

(57) ABSTRACT

A measurement tool may be positioned downhole in a wellbore for measuring formation properties and drilling mud properties during a drilling operation. The measurement tool may include a body and an antenna. The body may include magnets for generating a magnetic field and a transmitter for transmitting a radiofrequency pulse. The antenna may be positioned proximate to the body to measure properties using nuclear magnetic resonant frequencies. The antenna may measure formation properties in a first volume of a formation using a first frequency. The antenna may measure drilling mud properties in a second volume in a borehole using a second frequency.

20 Claims, 5 Drawing Sheets

(56) References Cited

U.S. PATENT DOCUMENTS

| | | | | |
|---|---|---|---|---|
| 2016/0017702 | A1* | 1/2016 | Koscheev | E21B 47/002 166/66 |
| 2016/0305239 | A1* | 10/2016 | Hopper | E21B 47/13 |
| 2020/0158907 | A1* | 5/2020 | Li | E21B 41/00 |
| 2022/0043177 | A1* | 2/2022 | Bachman | E21B 47/026 |
| 2023/0043389 | A1* | 2/2023 | Folberth | G01V 3/28 |

OTHER PUBLICATIONS

Rismanto et al., "Explorative Study of NMR Drilling Fluids Measurement", Annual Transactions of the Nordic Rheology Society, vol. 15, 2017, 7 pages.

* cited by examiner

MEASURING FORMATION PROPERTIES AND DRILLING MUD PROPERTIES USING NUCLEAR MAGNETIC RESONANCE IN A WELLBORE

TECHNICAL FIELD

The present disclosure relates generally to wellbore drilling operations and, more particularly (although not necessarily exclusively), to using nuclear magnetic resonance to measure formation properties and drilling mud properties in a wellbore.

BACKGROUND

Logging-while-drilling operations can involve measuring formation properties during a drilling phase for a wellbore. Formation properties can be measured using tools, such a nuclear magnetic resonance ("NMR") measurement tool. An NMR measurement tool may use NMR signals to assist in identifying hydrocarbon-bearing zones, porosity and porosity partitions, pore typing, and in defining fluid volumes for assessing reservoir quality, among other uses.

During the drilling of a wellbore into a formation, a drilling fluid, such as a drilling mud, may be continuously circulated from a surface of the wellbore down to the bottom of the wellbore being drilled, and back to the surface again. The drilling fluid may serve several functions, such as transporting wellbore cuttings up to the surface to be separated from the drilling fluid. Additionally, the drilling fluid may provide hydrostatic pressure on the walls of the drilled wellbore. The hydrostatic pressure may prevent the walls from collapsing and the resulting influx of gas or liquid from the formation being drilled.

DETAILED DESCRIPTION

Figure 1:
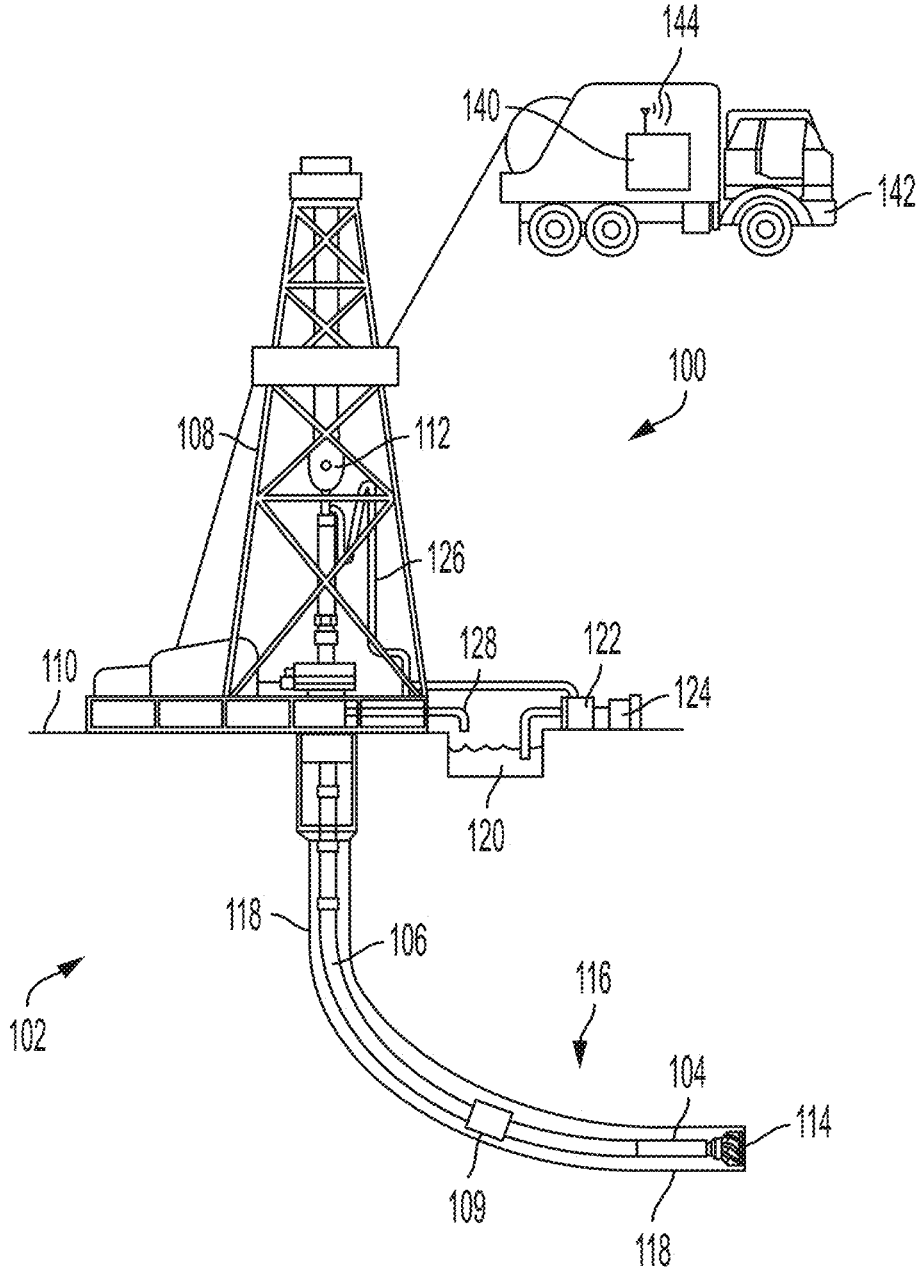
FIG. 1 is a cross-sectional view of a wellbore drilling system that can measure formation properties and drilling mud properties according to one example of the present disclosure.

Certain aspects and examples of the present disclosure relate to a measurement tool for using nuclear magnetic resonance ("NMR") for measuring formation properties and drilling mud properties in a wellbore during a drilling operation. The measurement tool may emit radio frequency ("RF") energy with the frequencies that satisfy an NMR resonance condition that causes an NMR response. The NMR response may be an excitation or refocusing of protons in sensitive volumes in either formation volumes or drilling mud volumes surrounding the measurement tool. The NMR responses may be measured by the measurement tool. The NMR responses can be used to determine properties of the formation and drilling mud. The measurement tool may measure drilling mud properties while also measuring formation properties, by tuning the NMR tool to different resonance frequencies, thus requiring only a single tool for measuring both types of properties. The measurement tool may transmit the measurements to a computing device positioned downhole or on the surface of the wellbore. The computing device may model the downhole environment using the measurements, and the drilling operation may be changed based on the update model. Using an NMR measurement tool to measure properties of drilling mud may provide downhole, real-time feedback that can be immediately implemented in the drilling operation.

Determining drilling mud properties, such as the oleophilic to aqueous phase fluid ratio of a drilling mud, may be beneficial to an efficient drilling operation. The oleophilic to aqueous phase fluid ratio allows operators of a drilling operation to determine the fluid rheology, the impact the drilling mud may have on the formation, the salinity of the drilling mud, the density, the filtration characteristics or requirements, etc. For example, a mud that is too viscous may reduce drilling efficiency; conversely a mud that is not viscous enough may be leached out to the formation and lost. A correctly formulated and maintained drilling fluid composition may be beneficial to maintain the filter cake and to ensure that drill solids, such as drill cuttings, make it to the surface.

In some examples, the oleophilic to aqueous phase fluid ratio can be measured using a technique known as a retort. A retort uses a distillation unit to heat and then distill the oleophilic phase and aqueous phase. The volume fraction of each phase is compared to the original known volume used during formulation of the drilling mud in order to measure the changes to the drilling mud during use. But this process may take an hour or longer and may not be automated. Furthermore, the lag in providing feedback may create issues in accurately and precisely modelling the downhole environment. As such, the retort process may perform slowly and provide measurements that lag relative to operational performance. This may lead to a delayed correction of the drilling fluid and a reduction in the overall efficiency of the drilling operation. Additionally, the retort process may utilize salts such as nitrates and formates that may be dangerous and potentially cause explosions. Thus, using an NMR measurement tool to determine properties of drilling mud may provide safer and more accurate measurements in real-time.

In some examples, the NMR measurement tool may measure axially-symmetric sensitive volumes surrounding the NMR measurement tool. The NMR measurement tool may generate an external magnetic field. The external magnetic field may be created using permanent magnets, coils, and magnetically permeable materials as has been show in many prior arts. The external magnetic field may be inhomogeneous and may have a particular strength at the surface of the tool, differing along the axial length of the tool as well. In some examples, the strength of the magnetic field may decrease with distance, though this is not universally the case. The strength of the field may increase or decrease in close proximity to the tool, but will fade away to effectively zero far from the tool. A nucleus in a magnetic field may have its energy states split such that it can be excited by the frequency corresponding to that gap of energy. This is the nuclear magnetic resonance condition. This happens when the nucleus has nuclear spin or "spin". The most commonly observed "spin" downhole is that of Hydrogen, also referred herein as a "proton," as the nucleus of a $^1H$ is just a proton. Because resonance occurs when the magnetic field ($B_0$) and the NMR frequency (f) satisfy the following equation: $f=\gamma B_0$, the magnetic field created has a gradient, and pulse NMR by means of an antenna and transmitter is used downhole, multiple sensitive volumes can be realized with the use of different frequencies. The NMR measurement tool may emit a radiofrequency pulse from an antenna with current generated in a transmitter. The emission of a short pulse may cause the protons in the corresponding sensitive volume to reaching the nuclear magnetic resonance condition, thus exciting them and making observation possible. Specialized sequences may be used in a gradient field to measure relaxation constants like T2, or T1 which have multiple pulses or varying durations. A classic example of a T2 sequence is the Carr-Purcell-Meiboom-Gill ("CPMG"). The sensitive volume is the volume created by the spins which are affected by a certain pulse. Because of the gradient, a wide variety of possible NMR active frequencies may be possible, but due to electronics and pulse length limitations may be nearly impossible to excite all the available frequencies at once. In general, the higher the transmission frequency of the NMR measurement tool, the slimmer the sensitive volume may be. Confined volumes, however, can be taken advantage of. For example, a first volume can be a volume of the formation surrounding a portion of the wellbore that adjoins the NMR measurement tool, and a second volume can be a volume of drilling mud circulating through the portion of the wellbore adjoining the NMR measurement tool. In response to the radiofrequency pulse, the protons in the first volume may respond to a first frequency and the protons in the second volume may respond a second frequency. The second frequency may be greater than the first frequency. In some examples, the system response function of the radiofrequency pulse may have a bandwidth that is less than the difference between the first frequency and the second frequency to avoid overlapping between the first frequency and the second frequency. Alternatively, the difference in frequencies can be selected such that there is less than a nominal percentage, e.g., 5%, of the drilling mud magnetization being included. The first frequency and the second frequency may be used to determine properties of the formation and the drilling mud.

In some examples, the NMR measurement tool may measure the first volume in the formation and the second volume in the wellbore during a drilling operation. Alternatively, the NMR measurement tool may measure drilling mud properties and formation properties during a change of drill pipes, rather than during a drilling operation. During the pipe change, the drilling motor may be stopped and the drilling mud movement may no longer be turbulent, which may allow for more accurate drilling mud measurements. Because drilling mud measurements conducted during pipe changes may be more accurate than measurements conducted during drilling operations, the pipe change measurements may be used as a calibration point for drilling mud measurements conducted during a drilling operation.

Illustrative examples are given to introduce the reader to the general subject matter discussed herein and are not intended to limit the scope of the disclosed concepts. The following sections describe various additional features and examples with reference to the drawings in which like numerals indicate like elements, and directional descriptions are used to describe the illustrative aspects, but, like the illustrative aspects, should not be used to limit the present disclosure.

FIG. 1 is a cross-sectional view of a wellbore drilling system 100 that can measure formation properties and drilling mud properties according to one example of the present disclosure. A wellbore used to extract hydrocarbons may be created by drilling into a subterranean formation 102 using the drilling system 100. The drilling system 100 may include a bottom hole assembly (BHA) 104 positioned or otherwise arranged at the bottom of a drill string 106 extended into the subterranean formation 102 from a derrick 108 arranged at the surface 110. The derrick 108 includes a kelly 112 used to lower and raise the drill string 106. The BHA 104 may include a drill bit 114 operatively coupled to a tool string 116, which may be moved axially within a drilled wellbore 118 as attached to the drill string 106. Tool string 116 may include one or more sensors, for determining conditions in the wellbore. Sensors, such as an NMR measurement tool 109, may be positioned on drilling equipment and sense formation properties or other types of properties about the drilling process. The NMR measurement tools 109 can send signals to the surface 110 via a wired or wireless connection, and the NMR measurement tools 109 may send real-time data relating to the drilling operation and formation to the surface 110. The combination of any support structure (in this example, derrick 108), any motors, electrical equipment, and support for the drill string and tool string may be referred to herein as a drilling arrangement.

During operation, the drill bit 114 penetrates the subterranean formation 102 to create the wellbore 118. The BHA 104 can provide control of the drill bit 114 as it advances into the subterranean formation 102. The combination of the BHA 104 and drill bit 114 can be referred to as a drilling tool. Fluid or "drilling mud" from a mud tank 120 may be pumped downhole using a mud pump 122 powered by an adjacent power source, such as a prime mover or motor 124. The drilling mud may be pumped from the mud tank 120, through a stand pipe 126, which feeds the drilling mud into the drill string 106 and conveys the same to the drill bit 114. The drilling mud exits one or more nozzles (not shown) arranged in the drill bit 114 and in the process cools the drill bit 114. After exiting the drill bit 114, the drilling mud circulates back to the surface 110 via the annulus defined between the wellbore 118 and the drill string 106, and hole cleaning can occur which involves returning the drill cuttings and debris to the surface. The cuttings and mud mixture are passed through a flow line 128 and are processed such that a cleaned mud is returned down hole through the stand pipe 126 once again.

The drilling arrangement and any sensors (through the drilling arrangement or directly) can be connected to a computing device 140. In FIG. 1, the computing device 140 is illustrated as being deployed in a work vehicle 142; however, a computing device to receive data from sensors and to control drill bit 114 can be permanently installed with the drilling arrangement, be hand-held, or be remotely located. Although one computing device 140 is depicted in FIG. 1, in other examples, more than one computing device can be used, and together, the multiple computing devices can perform operations, such as those described in the present disclosure.

Figure 2:
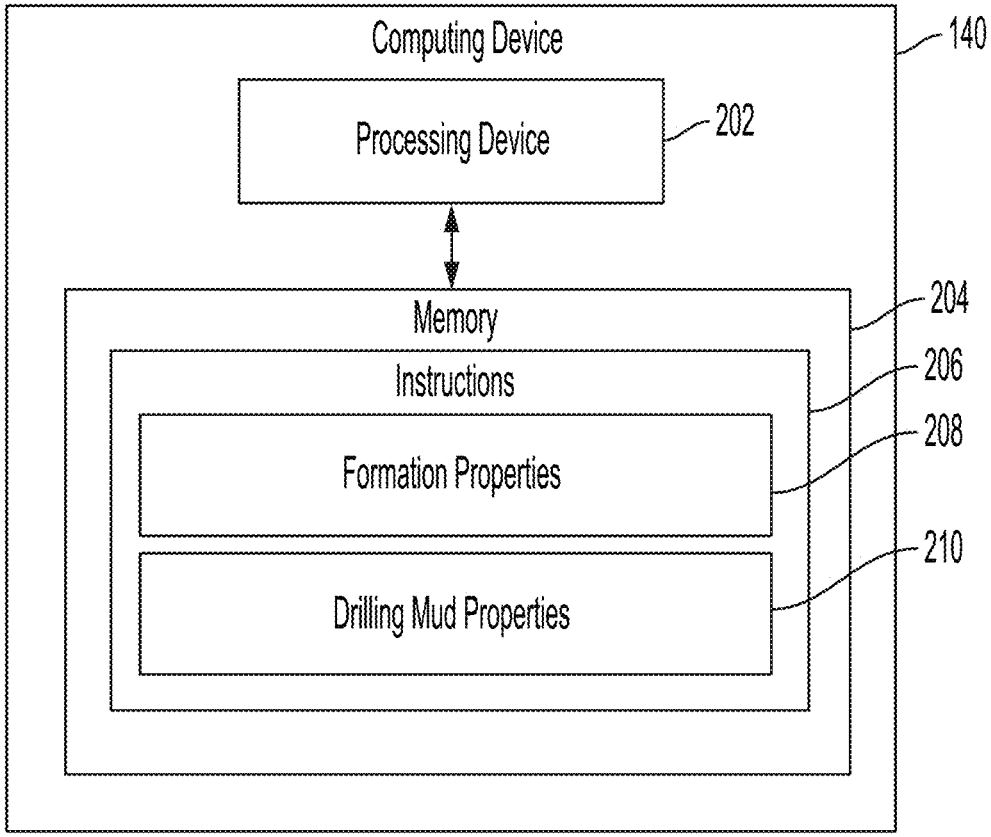
FIG. 2 is a block diagram of a computing device for determining formation properties and drilling mud properties according to one example of the present disclosure.

FIG. 2 is a block diagram of the computing device 140 for determining formation properties 208 and drilling mud properties 210 according to one example of the present disclosure. The computing device 140 includes a processing device 202 and a memory 204. The processing device 202 can include one processing device or multiple processing devices. Non-limiting examples of the processing device 202 include a Field-Programmable Gate Array (FPGA), an application-specific integrated circuit (ASIC), a microprocessor, etc. The processing device 202 can execute instructions 206 stored in the memory 204 to perform operations. In some examples, the instructions 206 can include processor-specific instructions generated by a compiler or an interpreter from code written in any suitable computer-programming language, such as C, C++, C#, etc.

The memory 204 can include one memory device or multiple memory devices. The memory 204 can be non-volatile and may include any type of memory device that retains stored information when powered off. Non-limiting examples of the memory 204 include electrically erasable and programmable read-only memory (EEPROM), flash memory, or any other type of non-volatile memory. In some examples, at least some of the memory 204 can include a medium from which the processing device 202 can read instructions 206. A computer-readable medium can include electronic, optical, magnetic, or other storage devices capable of providing the processing device 202 with computer-readable instructions or other program code. Non-limiting examples of a computer-readable medium include magnetic disk(s), memory chip(s), ROM, random-access memory (RAM), an ASIC, a configured processor, optical storage, or any other medium from which a computer processor can read the instructions 206.

In some examples, the processing device 202 can receive frequencies from an NMR measurement tool 109. The frequencies may include a first frequency associated with a first volume in a formation 102 and a second frequency associated with a second volume in drilling mud in a wellbore 118. The processing device 202 may execute the instructions 206 to determine formation properties 208 from the first frequency and to determine drilling mud properties 210 from the second frequency.

Figure 3:
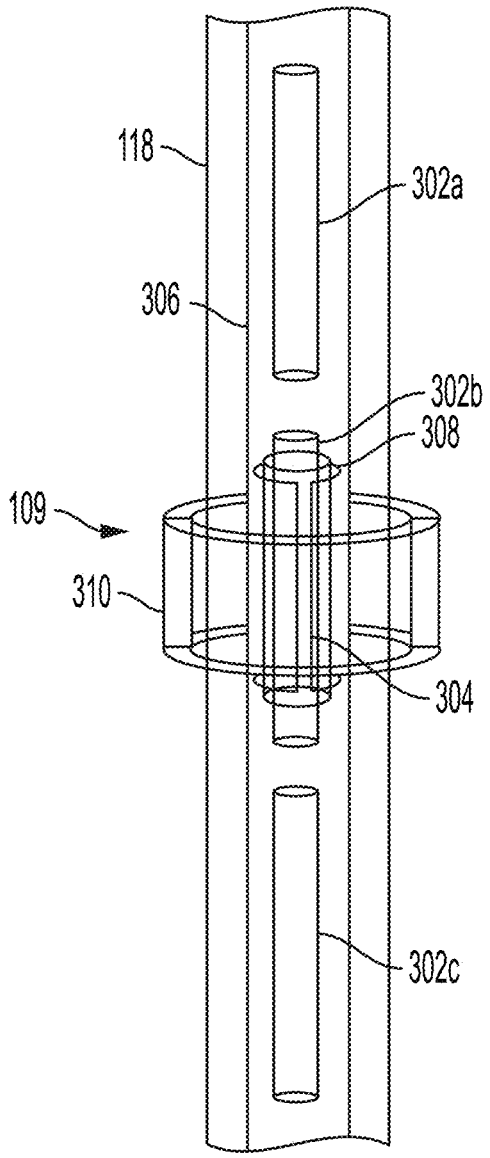
FIG. 3 is a side view of an NMR measurement tool in a wellbore for measuring formation properties and drilling mud properties according to one example of the present disclosure.

FIG. 3 is a side view of an NMR measurement tool 109 in a wellbore 118 for measuring formation properties 208 and drilling mud properties 210 according to one example of the present disclosure. The NMR measurement tool 109 includes an antenna 304 and a body 306. The body 306 includes magnets 302*a*, 302*b*, and 302*c*. In some examples, the antenna 304 may include an antenna build up. The antenna build up can include materials such as a copper shield, a magnetically permeable material, or an acoustic dampening material.

In some examples, the NMR measurement tool 109 may use the magnets 302*a-c* to generate a magnetic field around a sensitive volume 310 surrounding the NMR measurement tool 109. Alternatively, methods to generate a magnetic field or to use the earth's magnetic field to generate NMR active volumes are additionally viable. In some examples, the NMR measurement tool 109 may generate a magnetic field such that the gradient of the magnetic field, and a large enough variation of between a first pulsing frequency and a second pulsing frequency from the tool's antenna may cause different sensitive volumes surrounding the NMR measurement tool 109. For example, the magnets 302*a-c* may generate a magnetic field outside of the tool. A first volume in the subterranean formation 102 containing a portion of the formation 102 can be selected using an appropriately designed pulse with a particular resonance frequency and duration. A second volume contained inside the wellbore 118 which may contain drilling mud can be selected using an appropriately designed pulse with a particular resonance frequency and duration. The NMR measurement tool 109 may transmit, via a transmitter, a radiofrequency pulse through the sensitive volumes 310, which may cause the first volume to emit a first frequency, and the second volume to emit a second frequency. The NMR response (i.e., signal) of the frequencies may be measured by the antenna 304. The signal may be measured and recorded by the receiver path. The receiver path contains multiple steps which include a receiver which captures the signal, an analog to digital conversion, and a downhole controller board to send the signals to a computing device to determine properties of the formation 102 and drilling mud. Alternatively, the signals may be sent uphole to a computer for property determination while the drilling is happening, or read after the drilling is finished and analyzed on a computer.

The radiofrequency pulse may be selected such that the second frequency is greater than the first frequency, and the difference between the first frequency and the second frequency is larger than the larger bandwidth of the radiofrequency pulses. The bandwidth of the radiofrequency pulse may be determined by pulse width, pulse shape and the NMR system (transmitter and resonance circuit) response function, and the latter may depend on the NMR system realization. For a pulse sequence that consists of multiple pulses having different bandwidths, the largest bandwidth of a neighboring pulse may be used for the calculation. The selected frequencies may depend on the size of the wellbore 118 and the NMR measurement tool 109. For example, the antenna 304 may have an outer diameter of 5.25" and the wellbore 118 may have a borehole diameter of 7.25", which may correspond to a first frequency of 250 kHz for a 9" diameter first volume in the formation. It may also correspond to a second frequency of 340 kHz for a 6.75" to 7.25" diameter second volume, located between the antenna 304 and the wellbore 118. The NMR measurement tool 109 may transmit radiofrequency pulses with a bandwidth covering more than the frequency range of 250 kHz to 340 kHz. Other frequencies and radiofrequency pulse bandwidths may be used for other wellbore 118 and NMR measurement tool 109 configurations.

In some examples, the acquisition method for measuring signals from the first volume in the formation 102 may be dependent on formation evaluation objectives. To de-muddle the description from long rhetoric of transmitting a pulse at a particular frequency and then receiving signals from that frequency which is repeated many times within a full NMR downhole experiment such as a CPMG the process will be summed up by the term "frequency" and may be coupled with terms like "acquire" for the process of receiving signals and turning them into datasets. For example, the first frequency NMR response may be measured by the antenna 304 using a $T_2$ activation with a CPMG sequence, or a $T_1$ activation with saturation recovery activation. The acquisition method for measuring frequencies from the second volume in the wellbore can be, but are not limited to, a CPMG sequence. The data acquisitions of the two frequencies can be interleaved during the drilling phase to take advantage of the commonly long wait time required for formation fluids to reach full polarization state for the first frequency. Therefore, adding the second frequency from the drilling mud may not slow down the data acquisition of the first frequency. An example of a timeline for data acquisition is depicted in FIG. 4.

Figure 4:
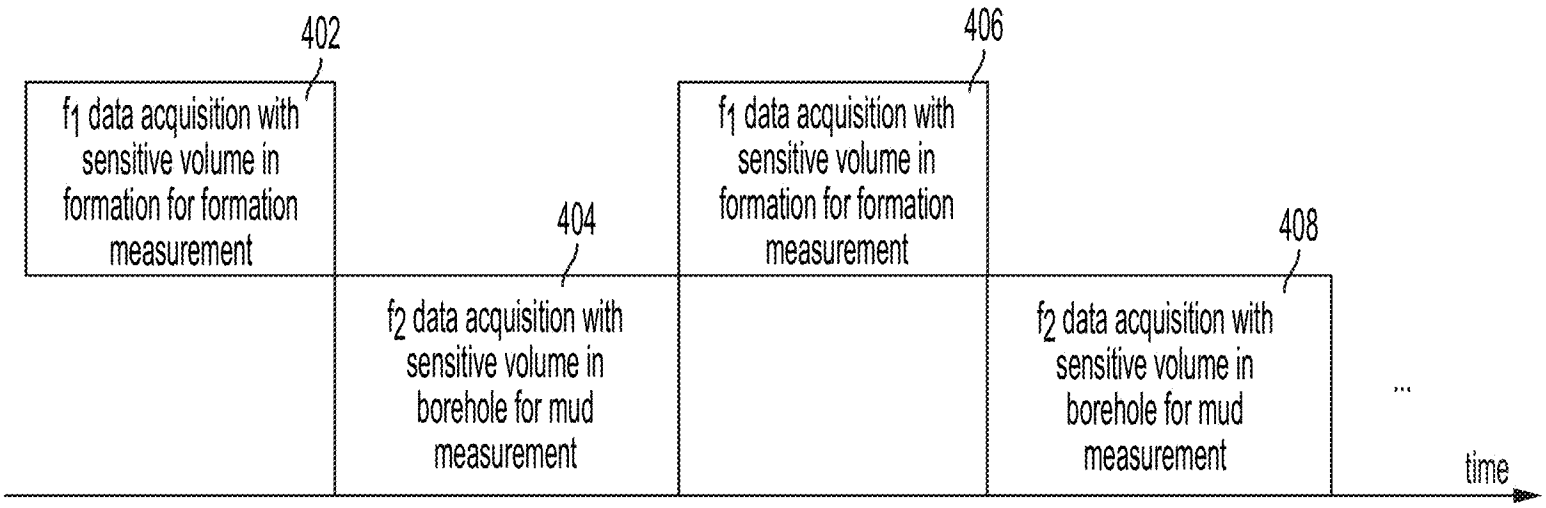
FIG. 4 is a timeline of a process for interleaving frequencies according to one example of the present disclosure.

Referring now to FIG. 4, at block 402 a first frequency ($f_1$) may be acquired from a sensitive volume 310 in the formation 102. The NMR relaxation time of drilling mud can be shorter than the NMR relaxation time of formation fluids. For example, water-based mud ("WBM") $T_2$ may be between 5-25 ms, and typical oil-based mud ("OBM") $T_2$ may be between 20-50 ms. On the other hand, the relaxation time for formation fluid may be as long as a few seconds.

Therefore, the wait time required for polarizing the formation fluids can be substantially longer than polarizing the drilling mud. Additionally, the length of the CPMG echo train may be substantially shorter for the drilling mud measurement than the formation measurement. So, the second frequency for the drilling mud can be acquired during the wait time for the first frequency. For example, after the first frequency CPMG echo train is acquired in block 402 and during the wait time for the first frequency, at block 404 the second frequency ($f_2$) CPMG echo train in a sensitive volume 310 of drilling mud in the wellbore 118 can be acquired for drilling mud measurement. Once the wait time for the first frequency pulse sequence is complete the method may repeat. At block 406 another first frequency CPMG echo train can be acquired from the formation 102, and at block 408 another second frequency CPMG echo train can be acquired from the drilling mud during the wait time for the first frequency pulse sequence. The frequencies may be interleaved together in the order of acquisition into a single dataset to be transmitted to a computing device or each individual acquisition from a frequency may be delivered to the computing device for processing.

As a particular example, the first volume in the formation 102 may have a $T_2$ relaxation time of 2 seconds, which may require at least 6 seconds wait time. Meanwhile for a second volume OBM $T_2$ of 40 ms, 60 ms of a CPMG echo train may be sufficient to recover a $T_2$ distribution, with a wait time of less than 200 ms. The second frequency from the OBM may be acquired during the 6 second wait time for the first frequency. In some examples, multiple second frequency echo trains may be acquired during the 6 second wait time. Stacking the multiple echo trains acquired with the second frequency may increase the quality of the data.

Figure 5:
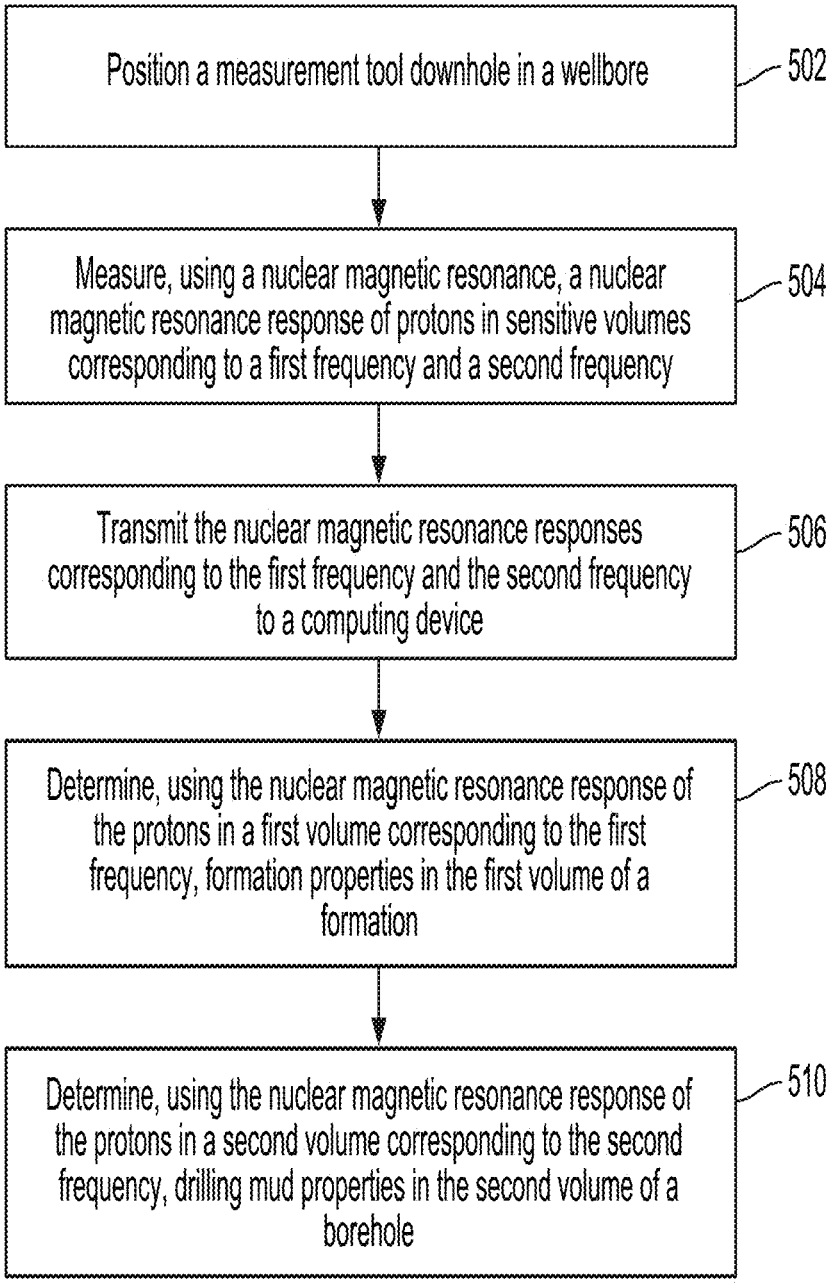
FIG. 5 is a flowchart of a process for determining formation properties and drilling mud properties in a wellbore according to one example of the present disclosure.

FIG. 5 is a flowchart of a process for determining formation properties 208 and drilling mud properties 210 in a wellbore according to one example of the present disclosure. In some examples, a measurement tool such as the NMR measurement tool 109 of FIGS. 1 and 3 may perform some operations of the flow chart, and a computing device such as the computing device 140 of FIGS. 1 and 2 may perform other operations. Other examples can involve more operations, fewer operations, different operations, or a different order of the operations shown in FIG. 5. At block 502, a measurement tool is positioned downhole in a wellbore. For example, the measurement tool may be positioned on or around production tubing, such as a tubing string or the drill string 106.

At block 504, the measurement tool acquires measurements, using nuclear magnetic resonance, a first frequency and a second frequency. The first frequency may be associated with a first sensitive volume in the formation 102 surrounding the measurement tool. The second frequency may be associated with a second sensitive volume of drilling mud in the wellbore 118 surrounding the measurement tool. The first frequency and the second frequency may be emitted and measured by the measurement tool due to a magnetic field and a radiofrequency pulse generated by the measurement tool.

At block 506, the measurement tool transmits the dataset recorded after an acquisition from the first frequency and the dataset recorded after an acquisition from the second frequency to a computing device. In some examples, the measurement tool may send the datasets to a computing device that is positioned downhole proximate the measurement tool. Alternatively or additionally, the measurement tool may transmit the acquired NMR datasets to a computing device that is positioned on a surface of the wellbore, such as the computing device 140 depicted in FIG. 1. In some examples, in order to save the transmission bandwidth, transmitting datasets or processed data to a surface computing device may only occur when new formation properties differ from previous formation properties by a predetermined amount.

At block 508, the computing device determines, using the first frequency and first volume chosen to be in the formation, formation properties 208 of the formation 102. At block 510, the computing device determines, using the second frequency and the second volume chosen to be in the wellbore, drilling mud properties 210 of the mud within the wellbore. The computing device may use the second frequency to determine an oil to water ratio ("O:W") and a fluid to solid ratio ("F:S"). For example, varying O:W content in OBM may correlate to the $T_2$ relaxation time for unaged and aged OBM sensitive volumes. The correlation may be approximately inversely linear to the O:W, i.e.:

$$T_{2,mud} \approx a\left(\frac{O}{W}\right) + b \tag{1}$$

where a and b are two constants that can be calibrated for a specific mud formula. While the absolute $T_2$ values may vary depending on the minerals of solid particles contained in the OBM and the type of based oil and additives formulating the OBM, the general trend may be the same and can be calibrated for any specific mud used for the drilling. More importantly, the change of O:W can be a gradual process. Plotting the measurement of drilling mud $T_2$ over time can show a trend of O:W change, which may give a more accurate assessment than an individual measurement. For example, an individual measurement may occasionally be contaminated by drilling vibrations. The trend over time may also be used to predict the future O:W change, therefore providing precise timing to adjust the mud formula at the mud tank 120.

The F:S can be obtained from the same downhole CPMG measurements. Because the solid particles in the drilling mud may not contribute to a measurable signal, the proton signal from the liquid in the drilling mud can be determined by:

$$M = c \cdot \tau \cdot (HI_w \cdot V_w + HI_o \cdot V_o) = c \cdot \tau \cdot \left(HI_w \cdot \frac{V_w}{V_o} + HI_o\right) \cdot V_o \tag{2}$$

where c is a calibration constant that normalizes the measured signal of 100% bulk water at a reference temperature, and the summation of the fraction of water, oil, and solid in the drilling mud adds up to 1:

$$V_w + V_o + V_{solid} = 1 \tag{3}$$

$\tau$ is a temperature correction factor, and HI is the hydrogen index of water or oil. Since $$\frac{O}{W} = \frac{V_o}{V_w} \tag{4}$$

Plugging Eq. (4) into Eq. (3), one obtains:

$$M = c \cdot \tau \cdot \left(HI_w \cdot \frac{W}{O} + HI_o\right) \cdot V_o \tag{5}$$

Combining Eq. (2) and Eq. (5):

$$M = c \cdot \tau \cdot \left( HI_w \cdot \frac{a}{T_{2,mud} - b} + HI_o \right) \cdot V_o \tag{6}$$

Thus, $$V_o = \frac{M}{c \cdot \tau \cdot \left( HI_w \frac{a}{T_{2,mud} - b} + HI_o \right)} \tag{7}$$

The solid to fluid ratio can be determined by:

$$\frac{S}{F} = \frac{V_{solid}}{V_w + V_o} = \frac{1 - V_w - V_o}{V_w + V_o} = \frac{1}{V_w + V_o} - 1 = \frac{1}{V_o \cdot \left( \frac{V_w}{V_o} + 1 \right)} - 1 = \frac{1}{V_o \cdot \left( \frac{W}{O} + 1 \right)} - 1 \tag{8}$$

Using Eq. (2) for W:O and Eq. (7) for $V_0$, F:S can be determined with NMR signal amplitude M and relaxation time $T_{2mud}$ measurements.

In some aspects, apparatus, method, and system for measuring formation properties and drilling mud properties using nuclear magnetic resonance in a wellbore are provided according to one or more of the following examples:

Example #1: A measurement tool of the present disclosure can include a body and an antenna. The antenna may be positionable proximate to the body to measure, using nuclear magnetic resonance, (i) formation properties in a first volume of a formation using a first frequency and (ii) drilling mud properties in a second volume in a borehole using a second frequency.

Example #2: The measurement tool of Example #1 may feature a transmitter configurable to emit a radiofrequency pulse.

Example #3: The measurement tool of any of Examples #1-2 may feature the second frequency being greater than the first frequency.

Example #4: The measurement tool of any of Examples #1-3 may feature a frequency difference between the second frequency and the first frequency that is greater than a bandwidth of the radiofrequency pulse emitted by the measurement tool.

Example #5: The measurement tool of any of Examples #1-4 may feature the measurement tool being is a single tool positionable downhole in a wellbore.

Example #6: The measurement tool of any of Examples #1-5 may feature the antenna being positionable to measure formation properties using the first frequency at a first time period and to measure drilling mud properties using the second frequency at a second time period. The measurement tool may be configurable to interleave the measurement of formation properties and the drilling mud properties into a combined dataset such that the formation properties are stored interleaved with the drilling mud properties.

Example #7: The measurement tool of any of Examples #1-6 may feature the measurement tool being configurable to measure formation properties and drilling mud properties during a drilling operation.

Example #8: A method of the present disclosure can include positioning a measurement tool downhole in a wellbore; measuring, using a nuclear magnetic resonance, a plurality of nuclear magnetic resonance responses corresponding to a first frequency and a second frequency; transmitting the plurality of nuclear magnetic resonance responses corresponding to the first frequency and the second frequency to a computing device; determining, using the plurality of nuclear magnetic resonance responses of the first frequency, formation properties in a first volume allocated inside a formation; and determining, using the plurality of nuclear magnetic resonance responses of the second frequency, drilling mud properties in a second volume allocated inside a borehole. Some or all of the method steps can be implemented by the measurement tool or the computing device.

Example #9: The method of Example #8 may feature the measurement tool further including a transmitter for emitting a radiofrequency pulse.

Example #10: The method of any of Examples #8-9 may feature the second frequency being greater than the first frequency.

Example #11: The method of any of Examples #8-10 may feature a frequency difference between the second frequency and the first frequency that is greater than a bandwidth of the radiofrequency pulse emitted by the measurement tool.

Example #12: The method of any of Examples #8-11 may feature the measurement tool being a single tool positioned downhole in the wellbore.

Example #13: The method of any of Examples #8-12 may feature the measuring (i) formation properties and (ii) drilling properties including measuring formation properties using the first frequency at a first time period; measuring drilling mud properties using the second frequency at a second time period; and interleaving the measurement of the first frequency and the measurement of the second frequency into a combined sequence such that the first frequency is interleaved before the second frequency.

Example #14: The method of any of Examples #8-13 can include measuring, by the measurement tool, the plurality of nuclear magnetic resonance responses corresponding to the first frequency and the second frequency during a drilling operation.

Example #15: A system of the present disclosure can include a tubing string, a measurement tool, and a computing device. The tubing string may be positionable downhole in a wellbore. The measurement tool may be positionable proximate to the tubing string and configurable to measure, using a nuclear magnetic resonance, a plurality of nuclear magnetic resonance responses corresponding to a first frequency and a second frequency. The computing device may be communicatively coupleable to the measurement tool and may comprise a processing device and a memory. The memory may comprise instructions that are executable by the processing device for causing the processing device to perform operations. The operations may include determining, using the plurality of nuclear magnetic resonance responses corresponding to the first frequency, formation properties in a first volume of a formation; and determining, using the plurality of nuclear magnetic resonance responses corresponding to the second frequency, drilling mud properties in a second volume of a borehole.

Example #16: The system of Example #15 may feature the second frequency being greater than the first frequency.

Example #17: The system of any of Examples #15-16 may feature a frequency difference between the second frequency and the first frequency that is greater than a bandwidth of a radiofrequency pulse emitted by the measurement tool.

Example #18: The system of any of Examples #15-17 may feature the measurement tool being a single tool positionable downhole in the wellbore.

Example #19: The system of any of Examples #15-18 may feature the measurement tool being configurable to measure formation properties using the first frequency at a first time period and to measure drilling mud properties using the second frequency at a second time period. The measurement tool may be configurable to interleave the measurement of formation properties and the drilling mud properties into a combined dataset such that the formation properties are stored interleaved with the drilling mud properties.

Example #20: The system of any of Examples #15-19 may feature the measurement tool being configurable to measure formation properties and drilling mud properties during a drilling operation.

The foregoing description of certain examples, including illustrated examples, has been presented only for the purpose of illustration and description and is not intended to be exhaustive or to limit the disclosure to the precise forms disclosed. Numerous modifications, adaptations, and uses thereof will be apparent to those skilled in the art without departing from the scope of the disclosure.

What is claimed is:

1. A measurement tool comprising:

a body;

a transmitter configurable to emit a radiofrequency pulse; and an antenna positionable proximate to the body to measure, using nuclear magnetic resonance, (i) formation properties in a first volume of a formation using a first frequency and (ii) drilling mud properties in a second volume in a wellbore using a second frequency, wherein a frequency difference between the second frequency and the first frequency is greater than a bandwidth of the radiofrequency pulse emitted by the transmitter, wherein the antenna is configured to acquire the second frequency during a wait time for the first frequency.

2. The measurement tool of claim 1, wherein the second frequency is greater than the first frequency.

3. The measurement tool of claim 1, wherein the measurement tool is a single tool positionable downhole in the wellbore.

4. The measurement tool of claim 1, wherein the antenna is positionable to measure formation properties using the first frequency at a first time period and to measure drilling mud properties using the second frequency at a second time period, and wherein the measurement tool is configurable to interleave the measurement of formation properties and the measurement of drilling mud properties into a combined dataset such that the formation properties are stored interleaved with the drilling mud properties.

5. The measurement tool of claim 1, wherein the measurement tool is configurable to measure formation properties and drilling mud properties during a drilling operation.

6. The system of claim 1, wherein the body comprises a plurality of magnets configurable to generate a magnetic field in the first volume or the second volume.

7. The system of claim 1, wherein the antenna further comprises:

an antenna build up comprising at least one of a copper shield, a magnetically permeable material, or an acoustic dampening material.

8. A method comprising:

positioning a measurement tool downhole in a wellbore;

emitting, by a transmitter in the measurement tool, a radiofrequency pulse;

measuring, by the measurement tool using a nuclear magnetic resonance, a plurality of nuclear magnetic resonance responses corresponding to a first frequency and a second frequency, a frequency difference between the second frequency and the first frequency being greater than a bandwidth of the radiofrequency pulse emitted by the transmitter, the second frequency being acquired during a wait time for the first frequency;

transmitting, by the measurement tool, the plurality of nuclear magnetic resonance responses corresponding to the first frequency and the second frequency to a computing device;

determining, by the computing device and using the plurality of nuclear magnetic resonance responses of the first frequency, formation properties in a first volume allocated inside a formation; and determining, by the computing device and using the plurality of nuclear magnetic resonance responses of the second frequency, drilling mud properties in a second volume allocated inside the wellbore.

9. The method of claim 8, wherein the second frequency is greater than the first frequency.

10. The method of claim 8, wherein the measurement tool is a single tool positioned downhole in the wellbore.

11. The method of claim 8, wherein measuring (i) formation properties and (ii) drilling mud further comprises:

measuring formation properties using the first frequency at a first time period;

measuring drilling mud properties using the second frequency at a second time period; and interleaving the measurement of the first frequency and the measurement of the second frequency into a combined sequence such that the first frequency is interleaved before the second frequency.

12. The method of claim 8, further comprising:

measuring, by the measurement tool, the plurality of nuclear magnetic resonance responses corresponding to the first frequency and the second frequency during a drilling operation.

13. The method of claim 8, wherein the method further comprises:

generating, by a plurality of magnets in the measurement tool, a magnetic field in the first volume or the second volume.

14. The method of claim 8, wherein the antenna includes an antenna build up comprising at least one of a copper shield, a magnetically permeable material, or an acoustic dampening material.

15. A system comprising:

a tubing string positionable downhole in a wellbore;

a measurement tool positionable proximate to the tubing string and configurable to measure, using a nuclear magnetic resonance, a plurality of nuclear magnetic resonance responses corresponding to a first frequency and a second frequency, wherein a frequency difference between the second frequency and the first frequency is greater than a bandwidth of a radiofrequency pulse emitted by the measurement tool, wherein the measurement tool is configured to acquire the second frequency during a wait time for the first frequency; and a computing device communicatively coupleable to the measurement tool and comprising:

a processing device; and a memory comprising instructions that are executable by the processing device for causing the processing device to:

determine, using the plurality of nuclear magnetic resonance responses corresponding to the first frequency, formation properties in a first volume of a formation; and determine, using the plurality of nuclear magnetic resonance responses corresponding to the second frequency, drilling mud properties in a second volume of the wellbore.

16. The system of claim 15, wherein the second frequency is greater than the first frequency.

17. The system of claim 15, wherein the measurement tool is a single tool positionable downhole in the wellbore.

18. The system of claim 15, wherein the measurement tool is configurable to measure formation properties using the first frequency at a first time period and to measure drilling mud properties using the second frequency at a second time period, and wherein the measurement tool is configurable to interleave the measurement of formation properties and the measurement of drilling mud properties into a combined dataset such that the formation properties are stored interleaved with the drilling mud properties.

19. The system of claim 15, wherein the measurement tool is configurable to measure formation properties and drilling mud properties during a drilling operation.

20. The system of claim 15, wherein the measurement tool further comprises:

a body comprising a plurality of magnets configurable to generate a magnetic field in the first volume or the second volume.

* * * * *